US005499421A

United States Patent [19]

Brice

[11] Patent Number: 5,499,421

[45] **Date of Patent: *Mar. 19, 1996**

[54] TWIN-HEADED TOOTHBRUSH

[76] Inventor: Michael F. Brice, 2 Ava Dr., Syosset, N.Y. 11791

[ * ] Notice: The term of this patent shall not extend beyond the expiration date of Pat. No. 5.121,520.

[21] Appl. No.: 76,667

[22] Filed: Jun. 15, 1993

[51] Int. Cl.[6] ..... A46B 9/04

[52] U.S. Cl. ..... 15/167.1; 15/167.2; 15/172; 15/143.1

[58] Field of Search ..... 15/167.1, 167.2, 15/110, 143.1, 166, 201, 172, DIG. 5; D4/104, 105, 106, 119

[56] References Cited

U.S. PATENT DOCUMENTS

| | | | |
|---|---|---|---|
| 18,653 | 11/1857 | Wadsworth | 15/167.1 |
| 860,840 | 7/1907 | Strassburger | 15/167.1 |
| 1,389,624 | 9/1921 | Carroll | 15/167.2 |
| 1,565,750 | 12/1925 | Nathanson | 15/167.2 |
| 1,668,216 | 5/1928 | Noel | 15/167.2 |
| 1,679,785 | 8/1928 | Quinn | 15/167.1 |
| 1,748,895 | 2/1930 | Noel | 15/167.2 |
| 1,868,368 | 7/1932 | Reese | 15/167.2 |
| 1,908,509 | 5/1933 | Davis | 15/167.2 |
| 1,928,328 | 9/1933 | Carpentier | 15/167.1 |
| 2,164,219 | 6/1939 | McGerry | 15/167.1 |
| 2,242,743 | 5/1941 | Brown | 15/167.1 |
| 2,266,195 | 12/1941 | Hallock | 15/201 |
| 2,528,992 | 11/1950 | Barr | 15/167.2 |
| 3,129,449 | 4/1964 | Cyzer | 15/201 |
| 3,152,349 | 10/1964 | Brennesholtz | 15/201 |
| 3,193,864 | 7/1965 | Makowsky | 15/172 |
| 3,350,737 | 11/1967 | Makowsky | 15/172 |
| 3,691,587 | 9/1972 | Makowsky | 15/167.1 |
| 3,742,549 | 7/1973 | Scopp et al. | 15/167.1 |
| 3,953,907 | 5/1976 | Froidevaux | 15/167.2 |
| 4,333,199 | 6/1982 | Rosario | 15/167.1 |
| 4,403,623 | 9/1983 | Mark | 15/172 |
| 4,449,266 | 5/1984 | Northemann et al. | 15/167.2 |
| 4,472,853 | 9/1984 | Rauch | 15/167.1 |
| 4,488,328 | 12/1984 | Hyman | 15/167.1 |
| 4,638,520 | 1/1987 | Eickmann | 15/167.2 |
| 4,667,360 | 5/1987 | Marthaler et al. | 15/167.1 |
| 4,691,405 | 9/1987 | Reed | 15/167.1 |
| 4,776,054 | 10/1988 | Rauch | 15/167.1 |
| 4,864,676 | 9/1989 | Schaiper | 15/167.1 |
| 4,876,157 | 10/1989 | Barman | 15/167.2 |
| 5,121,520 | 6/1992 | Brice | 15/167.1 |
| 5,305,491 | 4/1994 | Hegemann | 15/167.2 |

FOREIGN PATENT DOCUMENTS

| | | | |
|---|---|---|---|
| 642976 | 9/1928 | France . | |
| 855253 | 5/1940 | France | 15/167.2 |
| 818794 | 5/1952 | Germany . | |
| 3703288 | 8/1988 | Germany | 15/167.2 |
| 4115943 | 11/1991 | Germany | 15/167.2 |
| 594027 | 5/1959 | Italy . | |
| 286708 | 12/1991 | Japan | 15/167.1 |
| 2192784 | 1/1988 | United Kingdom | 15/167.2 |
| 13691 | 7/1993 | WIPO | 15/167.2 |

*Primary Examiner*—Gary K. Graham
*Attorney, Agent, or Firm*—Pennie & Edmonds

[57] ABSTRACT

A new and improved toothbrush has a pair of discreet twin brushing heads. The heads are arranged side-by-side with independent head flexure. The heads are attached to the handle through use of two discrete neck segments that have purposeful flexure. Each head is connected to one neck segment, thereby permitting independent head flexure. The heads may be angled relative to each other so as to provide two discrete stabilizing contact areas, these contact areas being the respective "high" areas of the two brushing heads that initially meet the teeth and gum surfaces.

27 Claims, 11 Drawing Sheets

TWIN-HEADED TOOTHBRUSH

BACKGROUND

As disclosed in U.S. Pat. No. 5,121,520 issued to the present inventor, Michael Brice, the disclosure of which is incorporated herein by reference, to effectively clean teeth and gum areas, complex maneuvering of a toothbrush is necessary. It is generally acknowledged that the great majority of individuals brush their teeth and gum surfaces primarily in a horizontal and semi-circular manner, even though this particular technique is not deemed to be the best way of cleaning the teeth and gum surfaces. There are two reasons why most individuals resort to this ineffective technique. First, conventional brushing heads are not particularly designed to follow the contours of the teeth and gum surfaces, and as an extension of the human arm do not permit complicated and exact maneuvers to be performed. Second, most brushing takes place in the early morning when one first arises and in the evening just prior to retiring. This is a key factor, as demanding complicated procedures for this time of day and night are beyond the tolerance of most individuals. For these reasons, most individuals resort to a simple natural horizontal or semi-circular conventional brushing technique.

Numerous attempts have been made in the past as shown, for example, in U.S. Pat. Nos. 860,840 to Strassburger, 3,742,549 to Scopp et al., and 4,667,360 to Marthaler et al to improve the design of the toothbrush. The bristles and/or head of these prior inventions are angled relative to the handle portion. More particularly, U.S. Pat. No. 860,840 to Strassburger discloses a toothbrush having two rows of bristles which are sloped in opposite directions relative to each other and a central section of bristles arranged parallel and located between the two outside rows. However, these prior inventions do not simultaneously and/or independently accommodate different contours of the teeth.

In other prior art patents, adjacent head portions of a toothbrush are made to pivot or flex relative to the handle portion so that the bristles are better able to conform to the contours of the teeth and gum surfaces. Such an arrangement is shown in U.S. Pat. Nos. 1,928,328 to Carpentier, 2,266,195 to Hallock, 3,152,349 to Brennesholtz, 4,333,199 to Del Rosario, 4,488,328 to Hyman, 4,691,405 to Reed, and 4,776,054 to Rauch. More particularly, U.S. Pat. Nos. 4,333,199 to Del Rosario and 4,488,328 to Hyman disclose a toothbrush having a single discreet brushing head that can be pivoted about the handle. The Del Rosario patent, in addition, discloses a brushing head that can rotate about three planes.

U.S. Pat. Nos. 1,928,328 to Carpentier, 2,266,195 to Hallock, 3,152,349 to Brennesholtz and 4,691,405 to Reed show a toothbrush head capable of flexing or articulating relative to the handle. Specifically, the brushing head comprises a plurality of serially arranged flexing head segments, whereby the segments flex in unison or relative to each other.

Finally, U.S. Pat. No. 4,776,054 to Rauch discloses a toothbrush head having three arranged brushing segments, whereby the central segment is aligned with the handle and the two segments on either side are symmetrically arranged relative to the central segment. The bristles on the outer sides of the Rauch patent have narrow, blade-like, contact points which are likely to induce excessive pressure to the gum due to the narrow contact points. In other words, the narrow blade-like bristles inherently place higher excessive concentrated pressure on the gum more so than bristles with a larger contact area which can spread pressure evenly to the larger contact area.

None of the prior art toothbrushes are directed to overcoming ineffective brushing techniques. These prior inventions do not disclose a toothbrush that overcomes the individual's anatomically limited abilities to effectively clean the curvilinear surfaces of the teeth and provide for gentle stimulation of the varying gum tissues without harm or discomfort for the user by utilizing side-by-side arranged brushing heads.

SUMMARY OF THE INVENTION

Accordingly, one object of the present invention is to provide an improved cleaning instrument for cleaning teeth and stimulating gum surfaces that is specifically designed, addresses, and accepts the reality that most individuals brush their teeth and gum surfaces with a conventional technique determined by the imposed limited anatomical nature of a brushing device as an extension of the human arm.

Another object of the invention is to provide a toothbrush that contacts all the dental regions encountered within the mouth, especially the inter-dental regions.

Another object of the invention is to provide a toothbrush that stimulates the gum/gingival tissue areas while at the same time effectively cleaning the teeth and gum surfaces using a conventional technique.

Another object of the invention is to provide a toothbrush with two stabilizing points while brushing, the two points being the respective high areas of the two brushing heads.

Another object of the invention is to provide a toothbrush that effectuates a purposeful stopping/pausing action to allow the user to experience a momentary "fixing" of the brush heads on the individual tooth and gum areas.

Another object of the invention is to provide a toothbrush with twin heads, whereby each head is resiliently fixed at a predetermined angle relative to the handle portion, and the heads are positioned in the opposite angles relative to the handle portion.

Another object of the invention is to provide a toothbrush with twin heads, whereby each head moves independently of the other about the handle portion.

Another object of the invention is to provide a toothbrush with a pair of discreet laterally positioned brushing heads, whereby each head flexes independently of the other about the handle portion and the two heads are biased toward to each other.

Another object of the invention is to provide a toothbrush with a pair of discreet laterally positioned brushing heads, whereby each head pivots independently of the other about the handle portion and the two heads are angled toward each other so as to narrow the gap between the inner rows of bristles.

Another object of the invention is to provide a toothbrush with a V-shaped, tapered handle for better gripping and maneuvering.

Another object of the invention is to provide a method of making the present twin-headed toothbrush.

The above-identified objects of the invention and other readily apparent advantages are achieved in one embodiment (more fully described in Detailed Description below) by providing two side-by-side arranged discreet brushing heads with the bristles or the heads angled in opposed directions relative to the handle portion of the toothbrush.

The two discreet brushing surfaces or areas represent an angled configuration complimentary to the brushing surfaces encountered in typical human teeth and gum areas. The particular orientation of the present toothbrush is designed to ensure that the brushing heads follow the contours of the gum and teeth surfaces with a primary objective of reaching and making contact with all dental surfaces, including the inter-dental regions.

In addition, the oppositely angled brushing surfaces provide two discrete stabilizing contact areas, these contact areas being the respective "high" areas of the two brushing heads that initially meet the teeth and gum surfaces. A critical aspect of the invention, which is not shown by any of the prior art, is that the side-by-side arranged brushing heads enable stable brushing strokes by providing stabilizing contact areas. This is especially so during brushing of the molars, which have irregular and non-linear surfaces. In other words, the two contact areas of the present invention provide a much better stable footing for the brush heads than the single contact area provided by the prior art brushes.

Specifically, in the Marthaler patent, the toothbrush concentrates the pressure applied by the user to a singular point on the brushing surfaces. Consequently, excessive concentrated pressure is applied to the surface encountered during brushing, causing wear and/or deformation of that surface. Additionally, this excessive concentrated pressure can abrade the gum surfaces, causing undue discomfort to the user. These disadvantages are overcome by the present design.

Further, while conventional toothbrushes merely skim over the inter-dental regions, the twin heads of the present invention results in a purposeful stopping/pausing action, allowing the user to experience a momentary "fixing" or adaptation of the brushing head on the individual tooth and the respective gum areas encountered therein without excessive concentrated pressure to a singular region. Hence, the novel configuration of the present toothbrush interrupts the conventional brushing technique with the brushing stroke "wanting" to pause on the individual tooth and respective gum areas encountered and thereby allows the user to momentarily concentrate on an individual tooth and a respective gum surface without excessive pressure to a singular point. Significantly, this pausing action does not require the user to understand and effect a new brushing technique. The novel brushing heads of the present invention automatically guide the brushing heads to follow each and every tooth and the respective gum surfaces in a way not achieved by the prior art.

Moreover, it should be noted that human dental structure consists of a large variety of different types of surfaces. One type is a substantially flat surface existing on the faces of the upper and lower front teeth. Even in these flat faces, there are closely aligned inter-dental regions which are frequently neglected during brushing simply because the conventional toothbrushes cannot effectively reach these inter-dental surfaces. As one progresses towards the back of the mouth, one encounters radically different teeth surfaces, principally the irregular surfaces of the molars of the top and bottom teeth. When brushing the molar regions, individuals generally brush with a somewhat diagonal backwards and forwards brushing angle. The present toothbrush is particularly useful and uniquely designed to effectively contact and clean the molar regions. The opposing high and low planes of the brushing heads of the present invention contact the peaks and valleys of the individual molars especially with a diagonally directed backward and forward brushing motion.

In addition, the opposing planes of the brushing surfaces create a natural "upward and over" movement when brushing the lower molar regions, and a mirror imaged "downward and over" movement when brushing the upper molar regions. This "upward and over" movement can be basically described as an arc in the shape of an inverted-"U". Specifically, the brushing heads start by brushing the outer vertical dental surfaces of the lower molars with conventional brushing strokes, i.e., back and forth movement across the lower outer molar surfaces. The brushing heads are then simultaneously shifted upward and to about 45 degrees, while continuously imparting the back and forth brushing strokes, to contact the curved outer surfaces at the junction of the outer surfaces and the uppermost surfaces of the lower molars. While continuously imparting the back and forth brushing strokes, the brushing heads are shifted directly onto the uppermost surfaces of the lower molars and then again shifted over and at about 45 degrees to the inner curved surfaces where the uppermost surfaces and the inner vertical surfaces of the lower molars meet. The brushing heads are shifted, once again, to complete the inverted-"U" arc, to contact the inner vertical surfaces of the lower molars while continuously imparting the back and forth brushing strokes. This inverted-"U" arcing motion is then repeated in the reverse order until the user is satisfied that the molars have been cleaned. The "downward and over" movement can be described as an arc in the shape of "U", this motion being the mirror image of the "upward and over" movement. Therefore, it is not deemed necessary to describe the "downward and over" movement in detail.

Individuals attempting to provide these "upward and over" and "downward and over" movements using a conventional "flat" headed toothbrush having a single contact plane can only attain limited success due to the constraint resulting from the single plane construction. In other words, a toothbrush with a single resting surface on the teeth and gum surfaces does not provide stable contact support to enable stable brushing strokes to be imparted to the molar surfaces. When attempting to brush the irregular and curved surfaces of the molars with a conventional toothbrush, the brushing head tends to slip off the irregular surfaces of the molars or wobble randomly about the single contact area, since the single contact surface acts as a pivot.

On the other hand, the present brushing heads are strategically situated relative to each other to provide two opposed contact planes and thus two resting surfaces on adjacently situated different planes. Because of these uniquely situated brushing heads, wobble and slipping are eliminated. Accordingly, during brushing of the curved and irregular surfaces, the two resting surfaces provide a stable footing which enables stable brushing strokes to be imparted on any desired surfaces to be brushed without the brushing head slipping or randomly wobbling thereabout. All "upward and over" and "downward and over" maneuvering when using a conventional "flat-headed" toothbrush are done on a random, haphazard basis that results from somewhat unconscious movement on the part of the user necessary to access all the surfaces of the molars. On the other hand, the two side-by-side opposing brushing head planes of the toothbrush of this invention are specifically designed to automatically guide the "upward and over" and "downward and over" movements when brushing the molar regions.

Moreover, the resistance created by the opposing planes of the brushing heads of the present toothbrush, as the bristles contact the varying tooth surfaces and the inter-dental regions therebetween, is transmitted back to the user purely through sensory feeling in the hand and arm of the user. This resistance enables the user to adjust the pressing force needed to scrub the areas being brushed without resulting in undue pressure and/or injury to the gum.

Further, the distance between the two respective high points of the present dual brushing heads can be varied to accommodate different widths or sizes of teeth. For instance, a child version of my toothbrush would have closer opposite high points while adult versions would have various distances to accommodate the needs of all adults. Furthermore, the unique angularly arranged heads of the present invention provide a plurality of discreet stabilizing contact areas to prevent excess pressure build-up and possible gum damage that can occur on a single concentrated point on the gum.

In another embodiment of the present toothbrush, each of the side-by-side arranged heads flexes independently about the handle as in the above-described embodiment. However, due to the fact that each head flexes independently, the bristles or the heads need not be angled in opposed directions relative to the handle portion. During brushing, the brushing heads flex independently to the differing surfaces encountered by each head, including the side, inside, and top and respective bottom areas of the individual teeth and adjacent gum areas.

In yet another embodiment, which may apply to any of the embodiments disclosed herein, the two-heads or the bristles thereof are angled inward toward each other so as to close the gap between the innermost rows of the two heads.

In yet another embodiment, which also may apply to any of the embodiments disclosed herein, the two heads are biased toward each other so as to keep the heads together when no forces are applied thereto.

The present toothbrush addresses the anatomic reality of the individual user's limited ability to achieve complex brushing requirements whether in a fully sensory conscious cognitive state or in an effected tiredness state and/or limited cognitive conscious ability.

The present invention accomplishes its objective of providing a superior cleaning device of the buccal, lingual, mesial and distal areas of the teeth, far surpassing any conventional toothbrushing device, and, the critical necessity of making contact with and, the stimulation of the gingival tissue of the individual through understanding and addressing the dynamic-interaction between the user and device and utilizing the material characteristics of the common material used in the manufacture and construction of toothbrush devices.

Specifically, the dynamic-interaction between the user and the toothbrushing device incorporates the transference of energy from the user to the device. This transference of energy either works for or against the objective of optimum teeth cleaning and proper gingival tissue stimulation needed for proper dental health of the individual.

This understanding of the energy transmitted by the user to the toothbrushing device during brushing and the dynamic established by such relationship has resulted in the purposeful design and construction of the present invention.

Common materials used in the manufacture and construction of toothbrushing devices typically have flexing and spring and spring-memory characteristics. The force/energy transmitted by user is increased in the body of material used, stored and then released. As well, further addressing and consideration of this interactive-dynamic here described is that this energy force is fully directed and realized in the two separate bristle-body heads of the present invention. The bristle-body heads of the present invention encounter resistance from the changing curvilinear structures of the teeth and gingival areas encountered during brushing. The force/energy transmitted by the user to the handle thereby transmitted to the neck portion and separate heads of the invention encounter resistance, thereby increasing the accumulation of energy in the material composition of the handle and heads. This energy is released when the differing resistance areas are passed and the "release" is realized in the "spring-action" of the two heads.

The accumulation and release of energy of the two separate brushing heads occurs rapidly during brushing and this action/activity is not necessarily perceived by the user, but nevertheless, is there, to aid in cleaning of teeth and stimulating of the gingival tissue, which is not obtainable by any conventional toothbrushing devices, including electro/mechanical devices.

DETAILED DESCRIPTION OF THE PREFERRED EMBODIMENT

Figure 1:
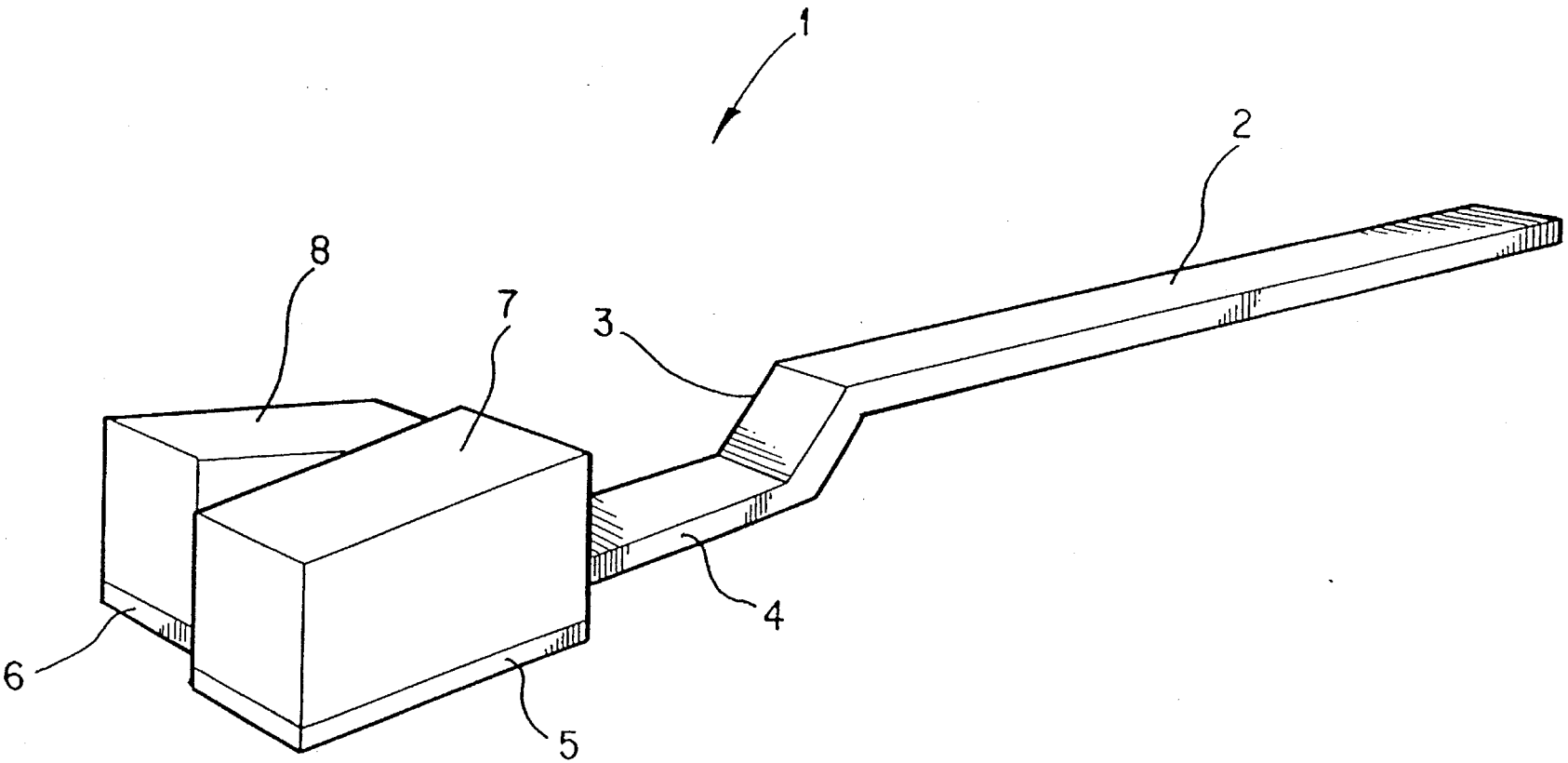
FIG. 1 is a perspective view of a dual-headed toothbrush in which the heads are fixed respect to the handle according to a first embodiment of the invention.

The foregoing invention and features and advantages of the present invention will be better appreciated from the following description.

The embodiments described herein have been contemplated for purposes of illustrating the principles of the present invention. Accordingly, the present invention is not to be limited solely to the exact configuration and construction as illustrated and set forth herein.

Many different embodiments of the present invention are contemplated in the drawings. For convenience, the same or equivalent elements of the present invention illustrated in the drawings have been identified with same reference numerals.

Figure 2:
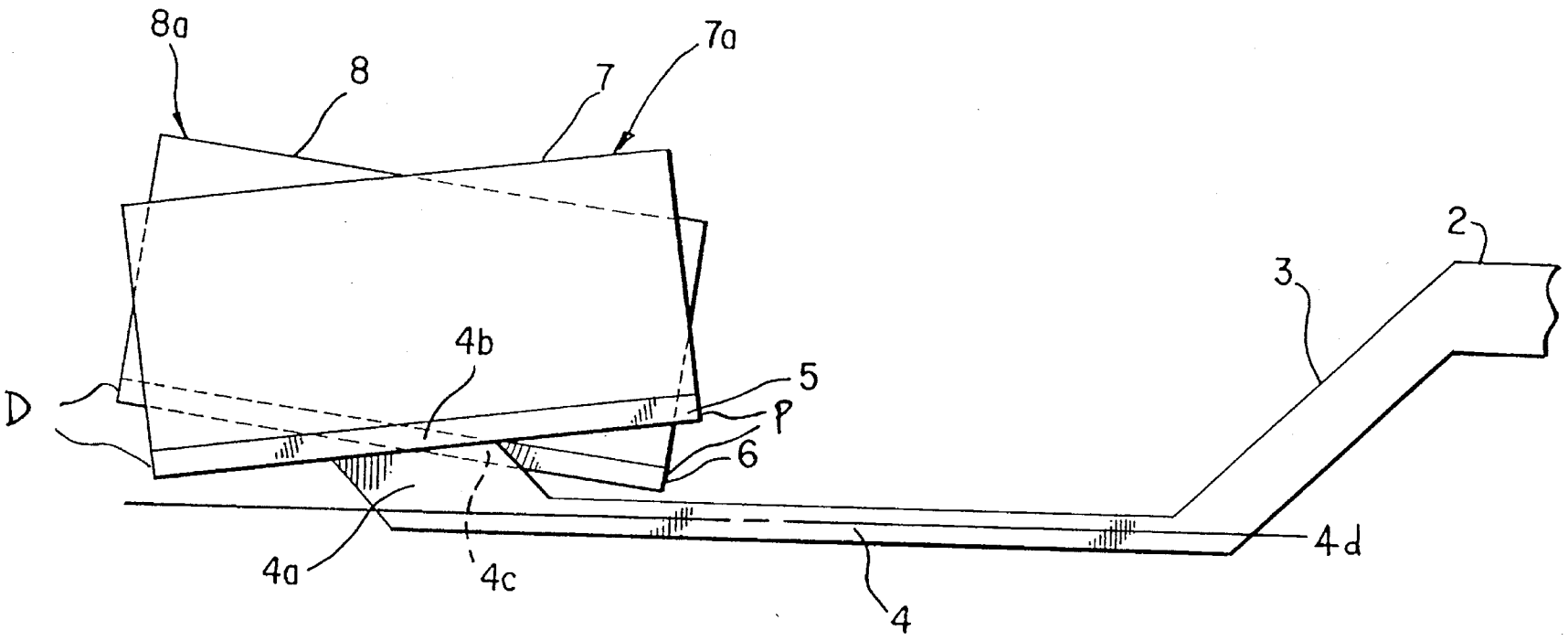
FIG. 2 is a side view of the fixed toothbrush of FIG. 1.
Figure 3:
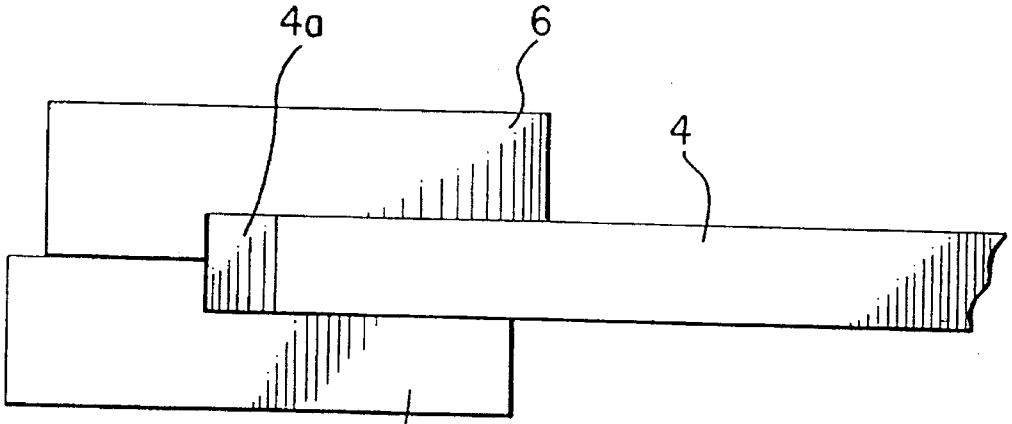
FIG. 3 is a bottom view of the fixed toothbrush of FIG. 1.

FIGS. 1–3 show a first embodiment of the dual-headed toothbrush (1) of the present invention. In this embodiment, brushing heads (5,6) are either integrally molded with a base member (4*a*), as shown in FIG. 2 or made separately and then attached to the base member by any conventional attaching method such as fusing, gluing, etc. The base member is integral with a neck portion (4) which in turn is integral with an offset portion (3) which in turn is integral with the handle (2). The neck portion (4) is made rigid or to flex by having the neck portion made of material capable of flexing when made with a relatively small cross sectional area in relation to the handle. Thus, when pressure is applied to the brushing heads while brushing teeth and gum surfaces, the neck portion flexes in response to the pressure applied during normal brushing and thereby allows for excessive pressure exerted by the user to be transmitted back to the user. The user can then on his/her accord ease-up on the pressure force being exerted.

FIG. 2 shows a side view of the first embodiment with a base member (4*a*) clearly shown. The base member is made with two sloping portions (4*b*, 4*c*) which are sloped in the opposite directions in relation to the neck portion (4) and the handle so that the distal ends (D) thereof are situated further away from the handle along the longitudinal direction of the handle than the proximal ends (P) thereof. The distal end of the sloping portion (4*b*) is situated further away from the axis (4*d*) of the neck portion (4). The proximal end of the sloping portion (4*b*) is situated closer to the neck portion axis (4*d*).

Each head is fixed to a respective sloping portion of the base by a conventional attaching method as previously noted. Each head defines an upper planar surface thereon which slopes due to the sloping portions. FIG. 3 shows the two distinct brushing heads as shown from the bottom view. In this embodiment, because the heads are angled and fixed relative to the base, each head forms a high contact area and a low contact area. The two respective high areas (7*a*, 8*a*) of the brushing heads form the stabilizing contact areas which provide stable positioning and resting places for the brushing heads as previously discussed in detail.

Figure 4:
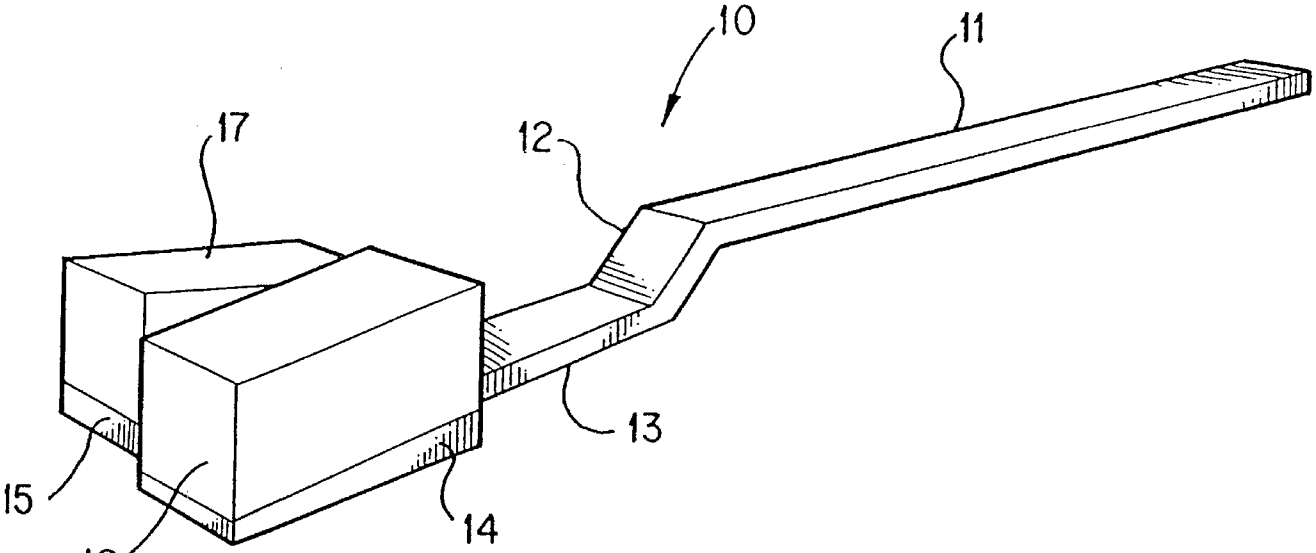
FIG. 4 is a perspective view of a fixed dual-headed toothbrush according to a second embodiment of the invention.
Figure 5:
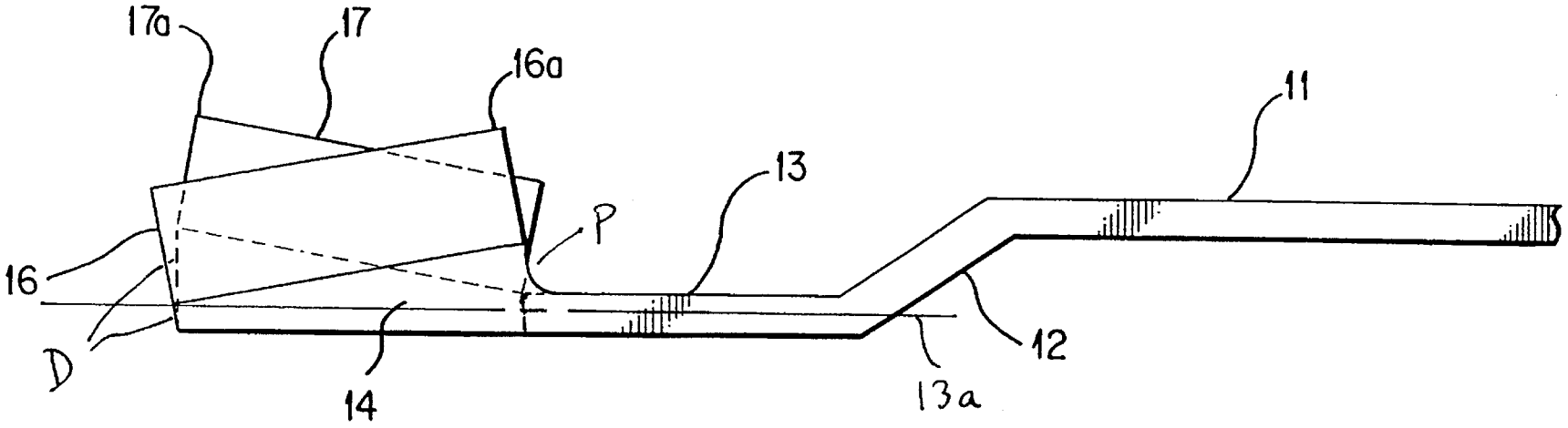
FIG. 5 is a side view of the second embodiment of the fixed toothbrush of FIG. 4.
Figure 6:
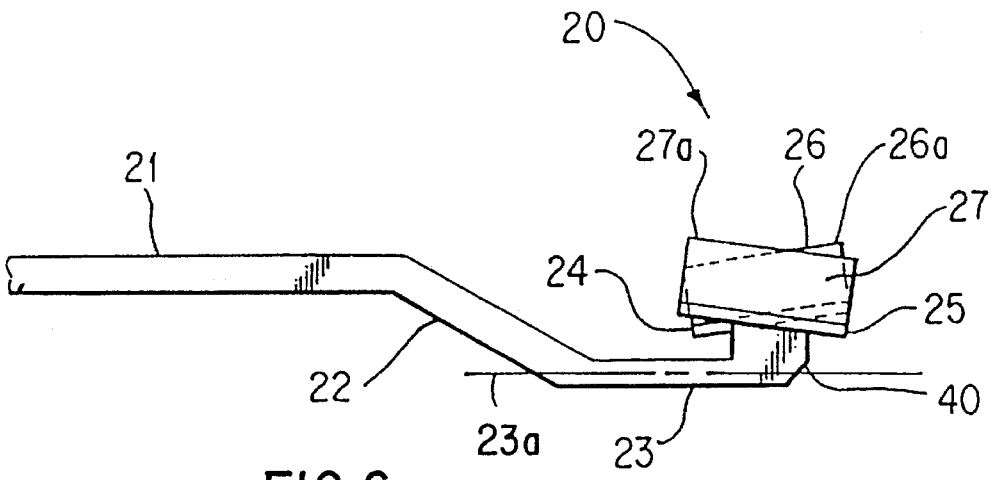
FIG. 6 is a side view of an articulating dual-headed toothbrush according to a third embodiment of the invention.

FIGS. 4 and 5 show a second embodiment of a dual-headed toothbrush. In this embodiment, the toothbrush is designated as element (10). The heads (14, 15) are integrally formed with or directly attached by using a conventional attaching method, as previously noted above, to a neck portion (13). The neck portion (13) is integral with an offset portion (12), and the offset portion (12) is in turn integral with the handle (11) in a manner similar to that as shown in the first embodiment in FIGS. 1–3. The heads (14, 15) are sloped in opposite directions in relation to the neck portion and the handle, similar to the first embodiment so that the distal end (D) of the head (15) is situated further away from the axis (13*a*) of the neck portion (13). The proximal end of the head (14) is situated closer to the neck portion axis (13*a*).

Also, similar to the first embodiment, the neck portion is designed to flex when pressure is applied to the heads while brushing the teeth and gum surfaces as previously discussed above. The two stabilizing points (16*a*, 17*a*) are formed in a manner similar to that as previously shown and discussed above in the first embodiment.

FIG. 6–9 show a third embodiment of a dual-headed toothbrush (20). However, unlike the other two embodiments, brushing heads (24, 25) are articulated to a base (40), which is fixed to a neck portion (23), rather than being fixed as in the other two embodiments. In common with the other two embodiments, the neck portion (23) is designed to flex or be rigid. As shown, the handle (21), offset portion (22), and the neck portion (23) are preferably integrally formed, as is with the other two embodiments.

Figure 7:
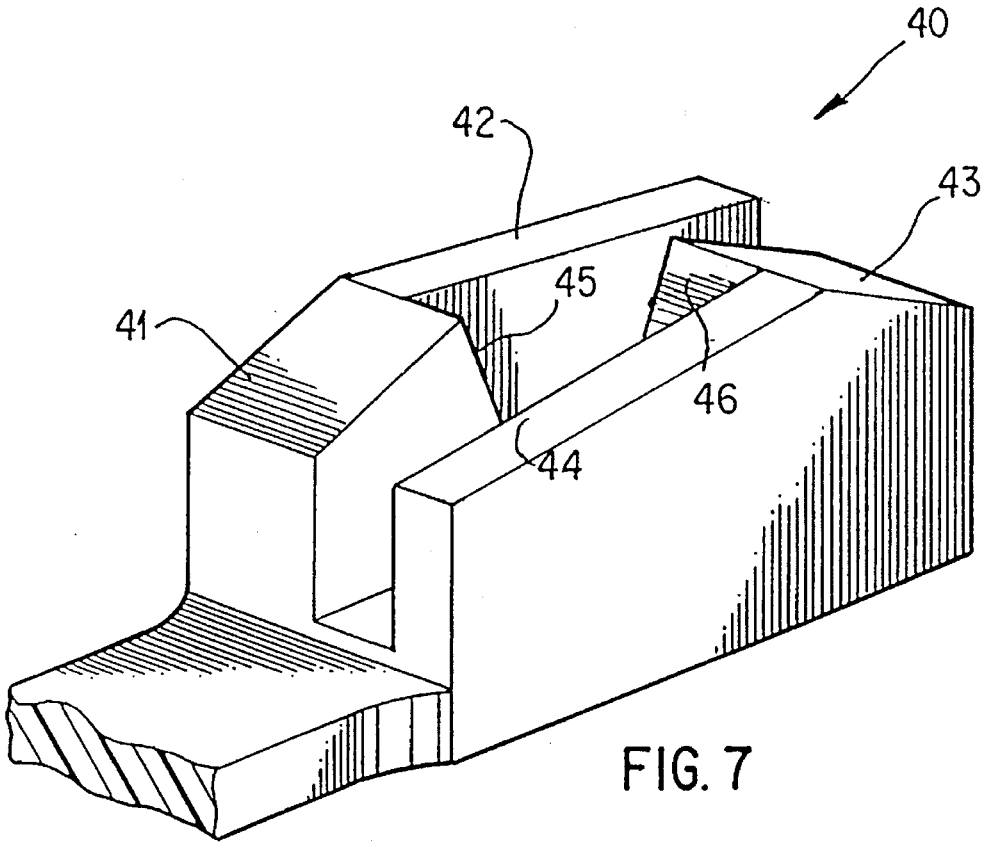
FIG. 7 is a perspective view of a base for the two heads of FIG. 6.

FIG. 7 shows a detailed perspective view of the base (40) with the brushing heads removed. As better shown in the top view of the base (40) in FIG. 8 and sectional view in FIG. 9, the brushing heads (24, 25) are biased by springs (49) to engage resting surfaces (41, 43) when no external pressure is applied to the brushing heads. Stop surfaces (42, 44) act to limit the pivoting movement of the brushing heads. In other words, each brushing head pivots about the spring between the respective two surfaces (41 and 42 or 43 and 44) with the surfaces acting as limits. Moreover, each brushing head pivots within the limits independently of the other and each head pivots only when a predetermined pressure is applied to the brushing head.

The rest surfaces (41, 43) are oppositely angled relative to the axis (23*a*) of the neck portion (23). Similarly, the stop surfaces (42, 44) are oppositely angled relative to the axis (23*a*) of the neck portion. In this embodiment, the initial contact areas or "high points" of both separate brushing heads continually respond to the changing contours of the teeth and gum surfaces encountered during brushing. Between the rest surfaces (41, 43) and the stop surfaces, (42, 44), a channel (50) having a central transverse opening (51) and oppositely extending longitudinal openings (52, 53) at the ends of the central opening are formed, as more clearly shown in FIG. 8. The central transverse opening (51) of the channel (50) is formed by opposing sloping walls (45, 46). From each of these sloping walls, a spring (49) extends outwardly into the oppositely extending longitudinal openings (52, 53) of the channel (50).

Figure 8:
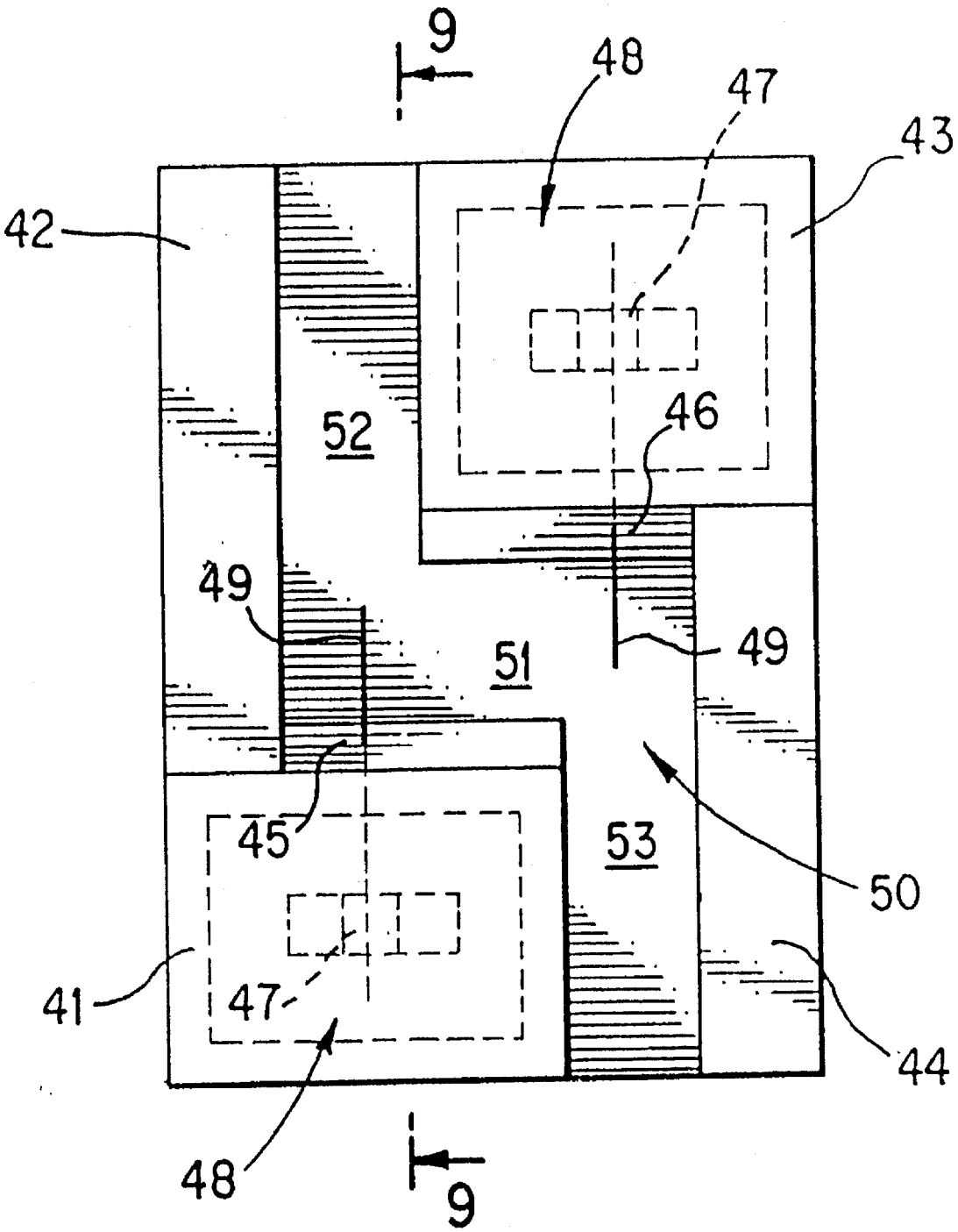
FIG. 8 is a top view of the base shown in FIG. 6.

FIG. 8 shows a top view of the base (40) with the springs (49) extending into the channel (50). Each rest surface (41 or 43) is formed with a cavity (48) which has a post (47) extending into the cavity from the underside of the rest surfaces, as shown more clearly in FIG. 9. The post (47) accommodates and supports the spring (49) in a manner as shown more clearly in FIG. 9.

Figure 9:
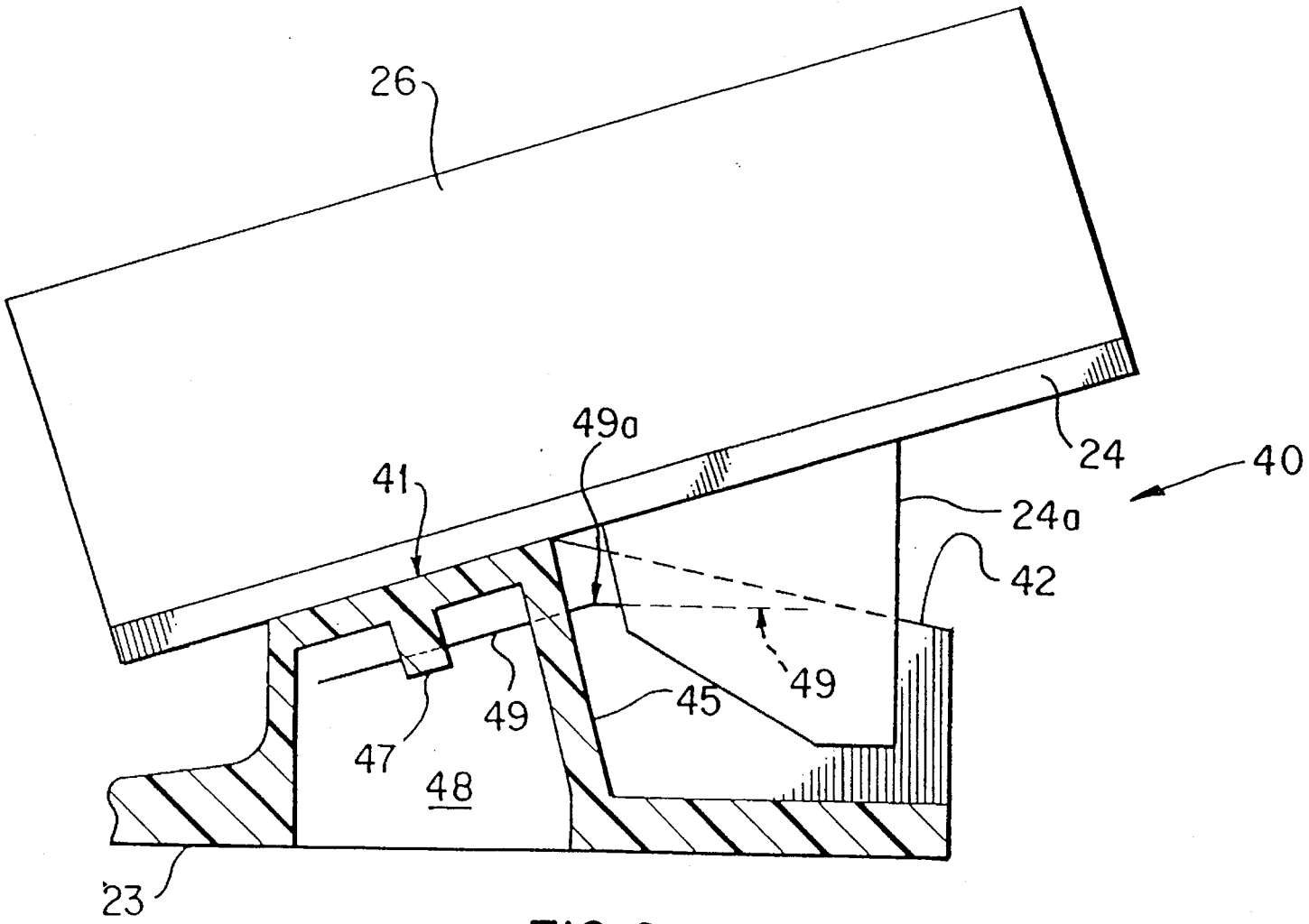
FIG. 9 is a cross-sectional view of the base showing a cavity according to the third embodiment taken along the line 9—9 of FIG. 8.

FIG. 9 is a cut-away view taken along the line 9—9 of FIG. 8, but showing a brushing head (24) installed in the head. Note that the other brushing head (25) is installed in an identical manner, but oppositely oriented. Therefore, a detailed description of only one of the brushing heads is provided. Each brushing head has a tab (24*a*) extending downwardly therefrom and into the longitudinal opening (51) of the channel (50). The spring (49) projects directly into the tab and can be provided with or without a bend (49*a*) between the slanted wall (45 or 46) and the tab. During the manufacturing process, one end of the spring (49) is molded into the tab (24*a*). The other end of the spring is inserted through an opening in the respective slanted wall (45 or 46) and through the opening in the post (47). Once the brushing head is properly aligned and positioned in the base, the spring (49) is secured into the base (40). One important aspect of this embodiment is that the springs (49) are completely enclosed within the base (40) to prevent either the gum, cheek, or tongue from contacting the spring (40), thus protecting the user from being pinched by the spring (40).

In this third embodiment, during normal brushing, the two independent brushing heads articulate, within the limit surfaces, to the differing irregular surfaces encountered, including the side, inside and top and respective bottom areas of the individual teeth and adjacent gum. Accordingly, because the brushing heads pivotingly follow the contours of every surface of each tooth, the pivoting action provides a proper brushing angle for each tooth, the angle varying to follow the contours of the teeth and gum surfaces, including the inter-dental surfaces. Moreover, the "resting" angle and the "stopped" angle have been calculated to achieve an angle of attack which promote proper cleaning. As previously discussed, when the brushing heads are situated in the "resting" angle, the brushing heads behave like the fixed brushing heads. In other words, the high areas (26*a*, 27*b*) form the stabilizing contact areas which provide resting place for the brushing heads as previously discussed in detail.

Figure 16A:
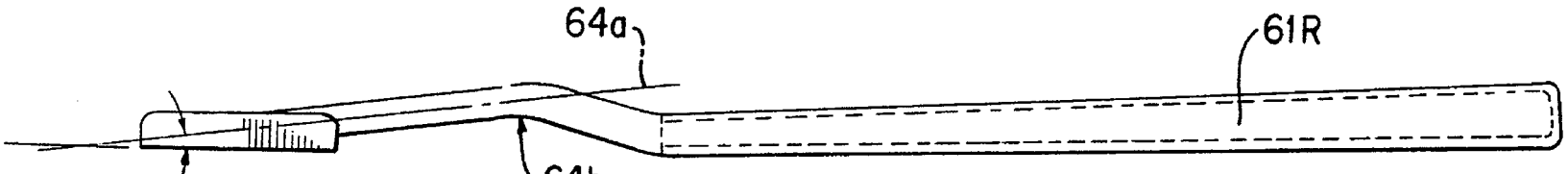
FIG. 16A is a right side view of the right segment of the toothbrush with the bristles or tufts omitted.
Figure 16:
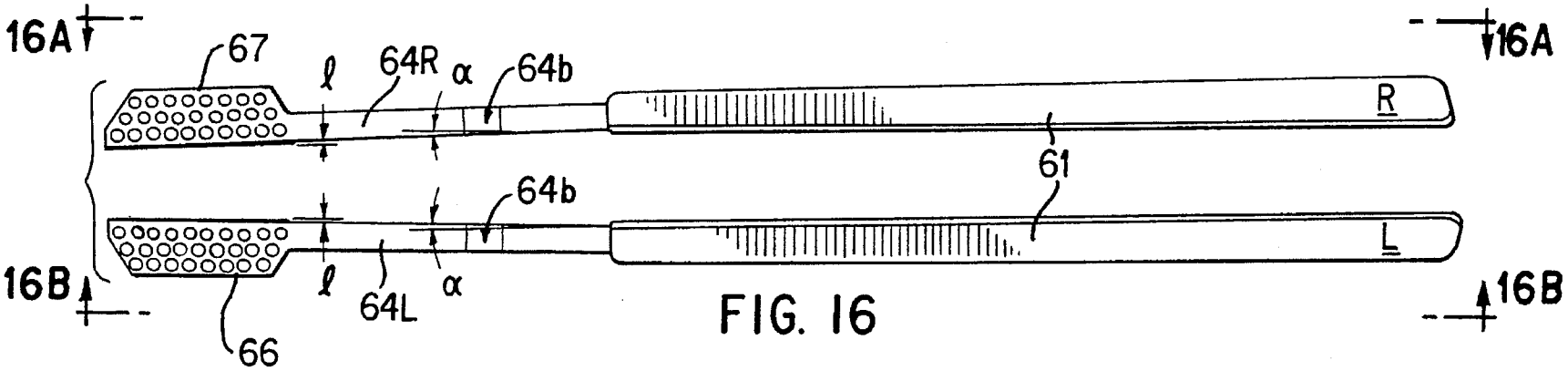
FIG. 16 is a top view of a dual-headed toothbrush with independently flexing heads according to a sixth embodiment of the invention shown prior to assembly.
Figure 16B:
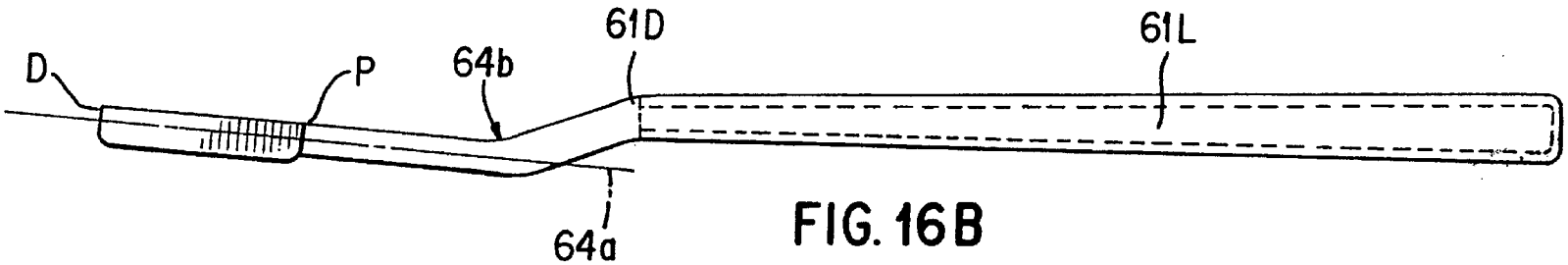
FIG. 16B is a left side view of the left segment of the toothbrush with the bristles or tufts omitted.

FIGS. 10–13 show another embodiment of the present toothbrush, which is labeled as element 60, which is substantially identical to the embodiment of FIGS. 16, 16A, 16B, with the exception of the shaped of the brushing heads and the number of bristles. Accordingly, these embodiments will be described together and same reference numerals will be used to describe the same or equivalent elements. Any differences between these embodiments will be specifically noted.

The embodiments of FIGS. 10–13 and 16, 16A, 16B comprise a pair of discreet heads (66,67) arranged side by side and flex independently of each other about the distal end (61D) of the handle (61). Specifically, each head is connected to its own neck portion (64R,64L) so as to provide independent flexing of each head. Each neck portion (64R, 64L) is symmetrically designed and, although not necessary, is preferably angled (α) slightly inwardly about 1°–3°, as shown in FIG. 16, to bias the heads toward each other to keep the heads from spreading apart in the direction shown by the arrows (S) in FIG. 10. However, the neck portion (64) is designed to flex laterally as well so that when the brushing surfaces are encountered with predetermined laterally and outwardly opposing forces, the heads spread apart in the direction of arrows (S). Moreover, the heads may also move laterally in unison in the same direction, for instance, during "up-down" or semicircular strokes. The heads may flex in any single direction or combination of different directions, independently of each other or in unison to follow the contours of teeth and gum. The degree of flexure of each neck portion segment (64R,64L) can be easily controlled by, for example, increasing or decreasing the length of the neck portion, or by changing the cross-sectional area thereof, or by changing the angle of the bend (64*b*), or using different material. Given the disclosure of the present invention, one of ordinary skill in the art could readily make a toothbrush of the present invention with any desired degree of flexure, to the liking of the user. Accordingly, detailed mechanical science of controlling the flexure need not be described in order to achieve the objectives of or to understand or carry out the present the invention.

Figure 11:
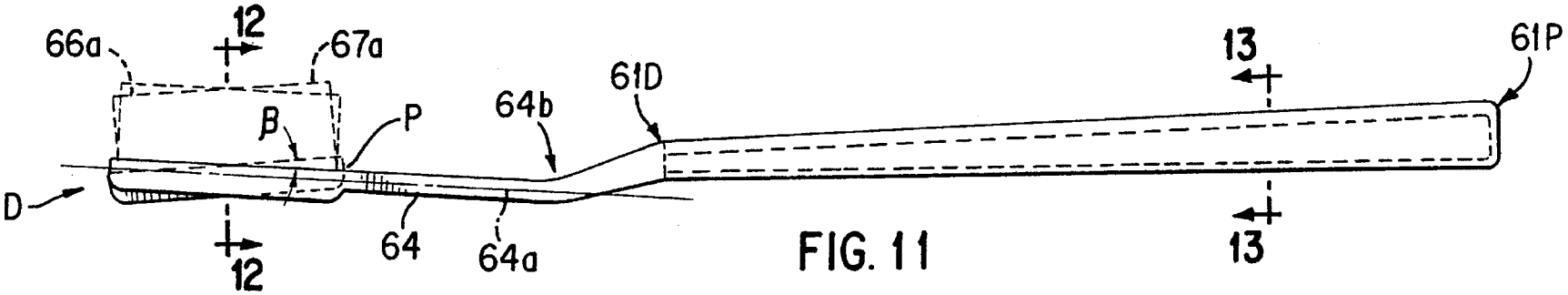
FIG. 11 is a side view of the independently flexing toothbrush of FIG. 10.

Moreover, as described in the previous embodiments, the heads (66,67) are sloped in the opposite directions relative to each other in relation to the neck portion (64) and the handle (61) so that when no forces are exerted, the distal end (D) of the head (66) is situated higher than that the distal end (D) of the head (67), as viewed in relation to FIG. 11. Each head forms a high contact area and a low contact area. The two respective high areas (66*a*, 67*a*) of the brushing heads form the stabilizing contact areas which provide stable positioning and resting places for the brushing heads as previously discussed in detail.

As previously indicated, the left and right neck portion segments (64R,64L) are symmetrical and should have substantially identical flexure or resiliency. As clearly seen from FIG. 16B, the left head (66) is collinearly aligned so that the neck portion axis (64*a*) is same as the axis of the left head (66). On the other hand, the right head is sloped about (β) degrees relative to the neck portion axis (64*a*) or to the left head (66) when no forces are exerted thereto. In other words, the right head (67) is offset relative to the left head (67) about (β) degrees. The angle β is preferably about 5°–10°, depending upon the user's preference of feel. However, an angle of 7° is deemed most preferable.

As more specifically shown in FIG. 16, in order to prevent the neck portion segments (64R,64L) from engaging rubbing each other, a small gap (l) is provided. In FIG. 16, the heads are each preferably provided with 27 bristle or tuft bunch holes, totalling 54, which has been determined to be optimal for comfort and feel for the inventor. However, comfort and feel are subjective terms, which differs from individual to individual. Accordingly, the bristle bunches should not be limited to 54, but may be made to any desired numbers. FIG. 11, for instance shows 74 bristle bunches.

Figure 12:
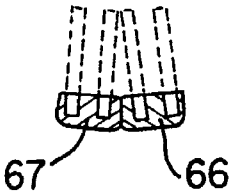
FIG. 12 is a cross-sectional view of the toothbrush heads taken along the line 12—12 of FIG. 11.
Figure 12A:
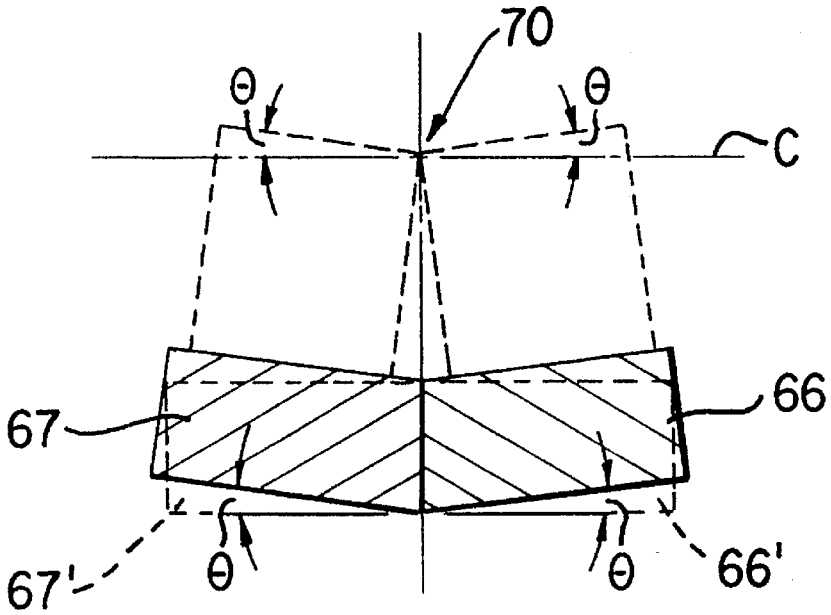
FIG. 12A is a graphical exploded view of FIG. 12, showing the details of the heads.
Figure 12B:
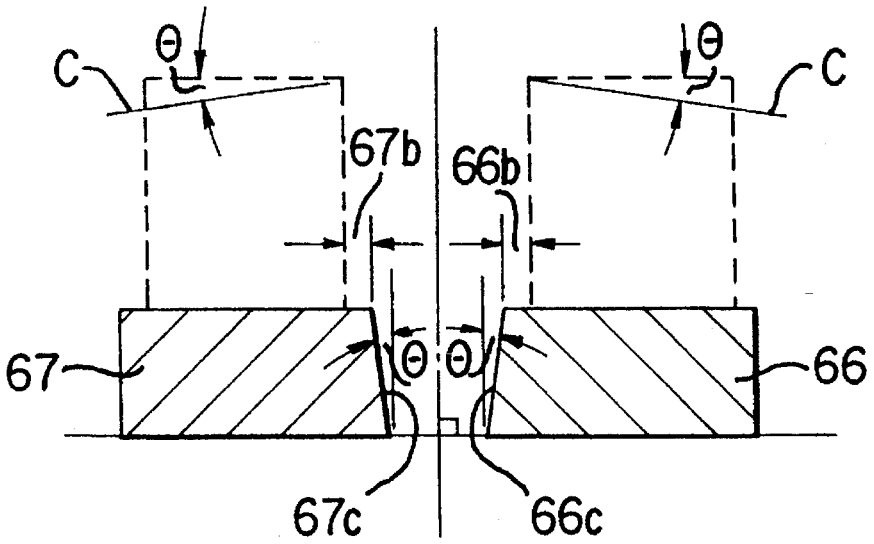
FIG. 12B is a graphical exploded view of FIG. 12, shown with the heads spread apart and laid flat.

FIG. 12 shows a cross-sectional view of the heads shown in FIG. 11. The cross-section is taken along the line 12—12 where the height of the left and right heads at the same level, i.e., the axis at which the left and right heads cross or intersect each other. The schematic detailed view of FIG. 12 is shown in FIGS. 12A,12B. During the manufacturing of the toothbrush, holes for the bristles are made and then the bristles are forced into the holes. If a sufficient thickness of wall is not provided between adjacent holes or outermost wall, the walls may crack or break during the bristle inserting step. Accordingly, a sidewall of certain thickness is required to maintain the bristles in place. Due to fact that a certain sidewall thickness (66*b*,67*b*) between the bristles and outermost wall should be present, when two heads are placed side-by-side, the gap between the innermost rows of the two heads are doubled. This gap may cause discomfort and may not be acceptable to certain individuals for that reason. There are two practical ways to close the gap at least to the normal gap spacing. First, the bristles may be placed at an angle relative to the heads (67',66' shown in phantom in FIG. 12A) so that the bristles converge as shown by reference numeral 70. Alternatively, the heads themselves may be pivoted about the angle (θ). When substantially rectangularly shaped cross-sectional heads are pivoted, only the top innermost edges contact each other. To prevent the edge to edge contact and to permit surface to surface engagement as shown in FIG. 12A, the innermost sides (66*c*,67*c*) are angled about θ, the same angle as the angle of inward tilt of the heads. Preferably, the angle of the tilt or the θ is about 5°. This angle is sufficient to close the gap to the point where the innermost rows of adjacent bristles touch each other or merge into each other, depending upon the height of the bristles. A parallelogram cross-section with a desired angle preferably is used.

Figure 10:
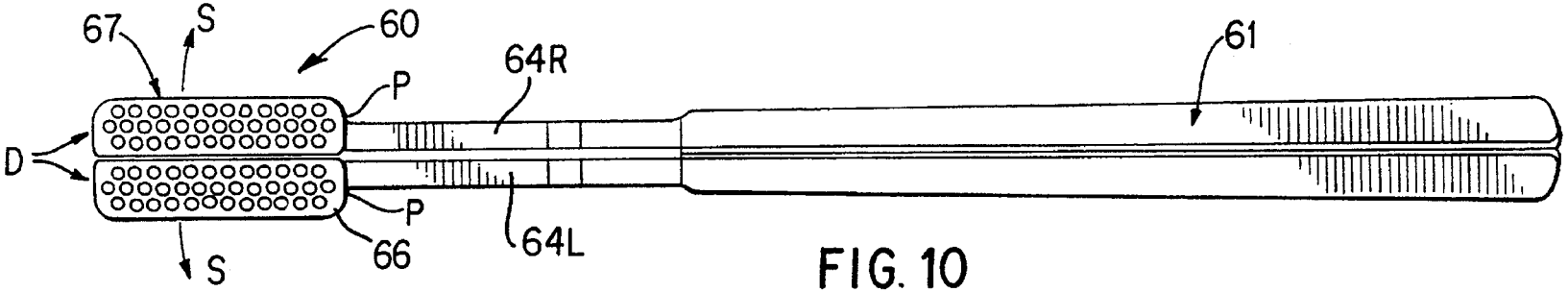
FIG. 10 is a top view of a dual-headed toothbrush with independently flexing heads according to a fourth embodiment of the invention.

When the heads or the bristles are tilted, the bristles create a "V"-shaped cross-section as shown in FIG. 12A. However, if the "V"-shaped cross-section is not desirable, the bristles may be cut along the line (C), at θ degrees. Due to the angling of the heads or the bristles, when forces are applied to the heads perpendicular to the axis (64*a*) of the heads, the heads will tend to spread apart in the direction of arrows (S), as shown in FIG. 10.

Figure 13:
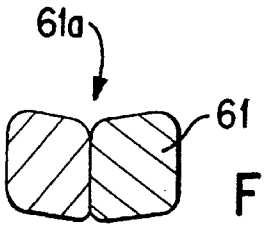
FIG. 13 is a cross-sectional view of the handle taken along the line 13—13.

FIG. 13 shows a cross-section of the handle (61) taken along the line 13—13. The cross-section of the handle as shown in FIG. 13 is substantially "V"-shaped, with a "V" groove for placing a thumb therein. This "V" groove prevents twisting of the handle and places a better control and maneuvering of the toothbrush.

Figure 15:
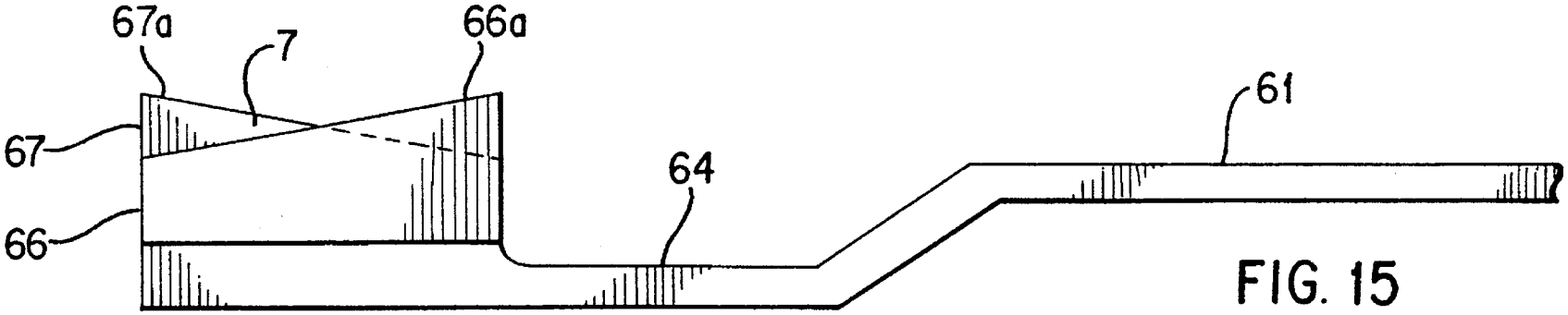
FIG. 15 is a side view of the independently flexing toothbrush of FIG. 14.
Figure 14:
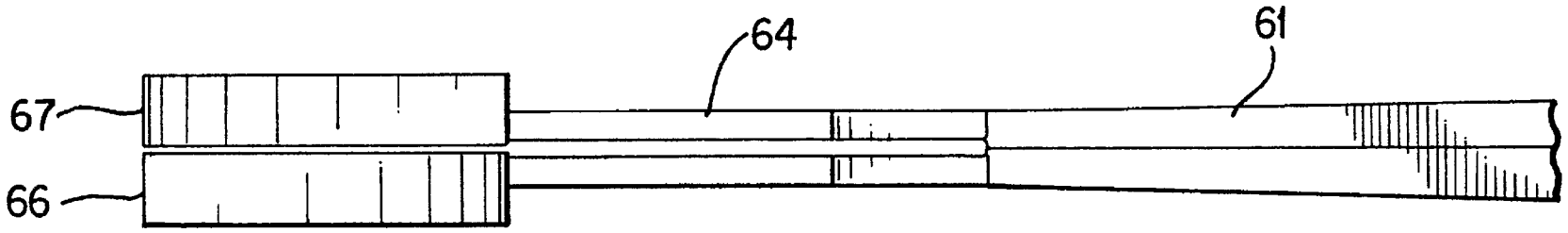
FIG. 14 is a top view of a dual-headed toothbrush with independently flexing heads according to a fifth embodiment of the invention.

FIGS. 14 and 15 show another embodiment of present invention. This embodiment is substantially similar to that of the embodiments shown in FIGS. 1–13 and 16, 16A,16B. Same reference numerals has been used to illustrate same or similar elements.

In the embodiment of FIGS. 14 and 15, however, the bristles rather than the heads are angled in opposed directions relative to the handle portion of the toothbrush. The two discreet brushing surfaces or areas representing an angled configuration complimentary to the brushing surfaces encountered in typical human teeth and gum areas are formed by varying the length of the bristles from low to high. Each head forms a high contact area and a low contact area, in which the two respective high areas (66*a*,67*a*) of the brushing heads form the stabilizing contact areas which provide stable positioning and resting places for the brushing heads as previously discussed in detail.

With respect to FIGS. 16, 16A,16B, the method of assembling or making the above-described toothbrush follows below.

In the present method, a conventional molding equipment are used to separately form an integral right segment and an integral left segments. The two segments are then bonded using a conventional bonding equipment, such as magnetic vibration welding or ultrasonic vibration welding. Specifically, conventional polymers of amorphous resins or semi-crystalline resins are molded to form the right integral segment consisting of the handle (61R), the neck portion segment (64R) and the head (67), and separately the left integral segment consisting of the handle (61L), the neck portion segment (64L) and the head (66). Thereafter, the heads are held flatly and holes for the bristles are drilled and then the bristles are plugged into the holes. The bristles are cut to any desired length, shape or profile, and then polished using conventional commercially available techniques. Then, left and right integral segments are brought together and then welded at the handle (61) using any conventional bonding or welding technique. For instance, BRANSON ULTRASONIC CORPORATION, makes commercial vibrational and ultrasonic welding machines capable of welding various types of plastics. See Technical Information PW-1, VW-4, PW-3, which discloses conventional techniques and devices for welding plastics, the disclosure of which is incorporated herein by reference.

The foregoing description is only illustrative of the principle of my invention. It is to be recognized and understood that the invention is not limited to the exact configuration as illustrated and described herein. Accordingly, all expedient modifications can be made within the scope and spirit of the invention. For instance, while not specifically shown in the drawings, the present invention encompasses two-headed toothbrush incorporating independently flexing heads, whether the heads are tilted in the opposite direction relative to each other or not.

What is claimed is:

1. A twin-headed toothbrush comprising:

a substantially elongated handle defining a first longitudinal axis extending along a length of said handle, said longitudinal axis defining a longitudinal direction;

first and second of side-by-side elongated bristle heads, said first head having a first plurality of bristles extending therefrom and said second head having a second plurality of bristles extending therefrom; and an elongated neck connected to said first and second heads, said neck defining a second longitudinal axis, said neck being positioned between one end of said handle to said heads and coupled thereto, wherein said first elongated head has a first distal end and a first proximal end, said first plurality of bristles extending from said first head between said first distal end to said first proximal end, ends of said first plurality of bristles forming a first brushing plane surface, said first distal end being situated further away from said handle along said first longitudinal axis than said first proximal end;

wherein said second elongated head has a second distal end and a second proximal end, said second plurality of bristles extending from said second head between said second distal end to said second proximal end, ends of said second plurality of bristles forming a second brushing plane surface, said second distal end being situated further away from said handle along said first longitudinal axis than said second proximal end, wherein when no pressure is applied to said heads, said first brushing plane surface and second brushing plane surface are angled relative to each other along the longitudinal direction with ends of a predetermined number of said first plurality of bristles nearest said first distal end of said first head being spaced perpendicularly further away from said second axis than ends of a predetermined number of said second plurality of bristles nearest said second distal end of said second head, and ends of a predetermined number of said second plurality of bristles nearest said second proximal end of said second head being spaced perpendicularly further away from said second axis than ends of a predetermined number of said first bristles nearest said first proximal end of said first head.

2. A twin-headed toothbrush according to claim 1, wherein each of said first and second plurality of bristles has at least two spaced rows of bristles and the spacing between adjacent rows of bristles of each said head is uniform.

3. A twin-headed toothbrush according to claim 1, wherein said first head defines a third axis and said second head defines a fourth axis, wherein one of said first and second heads extends collinearly with said neck such that the axis of said one of said first and second heads extends substantially collinearly with said second axis, and the other of said first and second heads extends at an angle relative to said neck such that said axis of said other of said first and second heads extends at an angle relative to said second axis.

4. A twin-headed toothbrush according to claim 1, wherein each of said heads has an upper planar surface with a distal end and a proximal end, said distal ends being situated further away from said handle along the longitudinal direction of said handle than said proximal ends, wherein when no pressure is applied to said first and second heads, said heads are angled relative to each other with said distal end of said upper planar surface of said first head spaced perpendicularly further away from said second longitudinal axis of said neck than said distal end of said upper planar surface of said second head, and said proximal end of said upper planar surface of said second head is spaced perpendicularly further away from said second longitudinal axis of said neck than said first proximal end of said upper planar surface of said first head.

5. A twin-headed toothbrush according to claim 1, wherein the length of said first plurality of bristles become progressively shorter from said first distal end toward said first proximal end and the length of said second plurality of bristles become progressively shorter from said second proximal end toward said second distal end.

6. A twin-headed toothbrush comprising:

an elongated handle having a first and second end and defining a first longitudinal axis extending along a length of said handle, said longitudinal axis defining a longitudinal direction;

first and second discrete side-by-side elongated flexible necks extending from said first end of said handle, said first and second necks defining second and third longitudinal axes respectively, said second and third axes lying in a common plane; and first and second discrete side-by-side elongated bristle heads, said first head having a first plurality of bristles extending therefrom and said second head having a second plurality of bristles extending therefrom, ends of said first plurality of bristles forming a first brushing plane surface and ends of said second plurality of bristles forming a second brushing plane surface, said first head extending from and connected to an end of said first neck and said second head extending from and connected to an end of said second neck; and wherein said first head has a first distal end and a first proximal end, said first plurality of bristles extending from said first head between said first distal end to said first proximal end, said first distal end being situated further away from said handle along said first longitudinal axis than said first proximal end;

wherein said second head has a second distal end and a second proximal end, said second plurality of bristles extending from said second head between said second distal end to said second proximal end, said second distal end being situated further away from said handle along said first longitudinal axis than said second proximal end, wherein when no pressure is applied to said heads, said first brushing plane surface is angled with respect to said second brushing plane surface along the longitudinal direction, ends of a predetermined number of said first a plurality of bristles nearest said first distal end of said first head being spaced perpendicularly further away from said plane than ends of a predetermined number of said second plurality of bristles nearest said second distal end of said second head are spaced from said third axis, and ends of a predetermined number of said second bristles nearest said second proximal end of said second head being spaced perpendicularly further away from said plane than ends of a predetermined number of said first plurality of bristles nearest said first proximal end of said first head are spaced from said first axis.

7. A twin-headed toothbrush according to claim 6, wherein a transverse cross section of said handle has a substantially V-shaped form, said handle is tapered along its length from said second end to said first end.

8. A twin-headed toothbrush according to claim 6, wherein said first and second necks are substantially parallel to each other.

9. A twin-headed toothbrush according to claim 8, wherein said first and second necks are offset at an angle relative to said handle such that said second and third axis of said first and second necks extend at an angle relative to said first axis of said handle.

10. A twin-headed toothbrush according to claim 6, wherein said necks are slightly tilted toward each other within said plane relative to said handle to bias said heads toward each other.

11. A twin-headed toothbrush according to claim 10, wherein a gap is provided between said necks to prevent said necks from abrading against each other.

12. A twin-headed toothbrush according to claim 10, wherein each of said necks extend at an angle of about 1 to 3 degrees relative to said first longitudinal axis of said handle toward each other within said plane.

13. A twin-headed toothbrush according to claim 6, wherein said first and second necks extend parallel to said handle.

14. A twin-headed toothbrush according to claim 13, wherein a gap is provided between said necks to prevent said necks from abrading against each other.

15. A twin-headed toothbrush according to claim 6, wherein each of said first and second plurality of bristles has at least two spaced rows of bristles extending substantially perpendicularly from a surface of said each head and wherein said first and second heads are slightly angled toward each other with adjacent ends of two adjacent rows of said first and second plurality of bristles of said first and second heads are spaced less than the spacing between ends of two adjacent rows of bristles on each of said first and second head respectively.

16. A twin-headed toothbrush according to claim 15, wherein said first and second heads are angled at about 5 degrees toward each other.

17. A twin-headed toothbrush according to claim 6, wherein said first head defines a fifth axis and said second head defines a sixth axis, wherein one of said first and second heads extends collinearly with one of said first and second necks respectively such that one of said fifth or sixth axes corresponding to said one head extends substantially collinearly with the axis corresponding to said one neck, and the other of said first and second heads extends at an angle relative to the other of said first and second necks such that said fifth and sixth axis corresponding to said other head extends at an angle relative to the axis corresponding to said other neck.

18. A twin-headed toothbrush according to claim 17, wherein said other of said first and second heads extends an angle of about 5 to 10 degrees relative to said other of said first and second necks.

19. A twin-headed toothbrush according to claim 6, wherein said first head defines a fourth axis and said second head defines a fifth axis, each of said first and second heads extends collinearly with said first and second necks respectively such that each of said fourth and fifth axes extends substantially collinearly with said second and third axes respectively.

20. A twin-headed toothbrush according to claim 6, wherein each of said heads has an upper planar surface with a distal end and a proximal end, said distal ends of said upper planar surfaces being situated further away from said handle along the longitudinal direction of said handle than said proximal ends of said upper planar surfaces, wherein when no pressure is applied to said first and second heads, said heads are angled relative to each other in the longitudinal direction with said distal end of said upper planar surface of said first head spaced perpendicularly further away from said plane than said distal end of said upper planar surface of said second head, and said proximal end of said upper planar surface of said second head is spaced perpendicularly further away from said plane than said proximal end of said first head of said upper planar surface.

21. A twin-headed toothbrush according to claim 6, wherein the length of said first plurality of bristles become progressively shorter from said first distal end of said first head toward said first proximal end of said first head and the length of said second plurality of bristles become progressively shorter from said second proximal end of said second head toward said second distal end of said second head.

22. A twin-headed toothbrush according to claim 6, wherein each of said heads has 27 bristle holes for said bristles.

23. A twin-headed toothbrush according to claim 6, wherein each of said heads has 37 bristle holes for said bristles.

24. A twin-headed toothbrush according to claim 6, wherein a cross section of said handle along a perpendicular direction to said first axis is substantially V-shaped.

25. A twin-headed toothbrush according to claim 24, wherein said handle is tapered from said second end to said first end.

26. A twin-headed toothbrush according to claim 6, wherein said handle comprises two elongated members, each having a parallelogram transverse cross-section, joined at sides thereof such that the two members form a substantially "V-shaped" cross-section.

27. A twin-headed toothbrush according to claim 26, wherein said handle is tapered along said length of said handle, from said second end to said first end.

* * * * *